United States Patent [19]

Ott

[11] 3,982,595

[45] Sept. 28, 1976

[54] ROCK BORING CUTTER WITH REPLACEABLE CUTTING ELEMENTS

[76] Inventor: Eugene Gray Ott, Dallas, Tex.

[73] Assignee: Dresser Industries, Inc., Dallas, Texas

[22] Filed: July 24, 1972

[21] Appl. No.: 274,532

[52] U.S. Cl. ..... 175/373; 175/351; 175/371

[51] Int. Cl. ..... E21b 9/14; E21c 13/01

[58] Field of Search ..... 175/350–352, 175/361, 364, 367, 368, 371–374, 382, 227

[56] References Cited

UNITED STATES PATENTS

| | | | |
|---|---|---|---|
| 1,143,275 | 6/1915 | Hughes | 175/367 |
| 1,673,285 | 6/1928 | Holdaway et al. | 175/350 |
| 1,705,055 | 3/1929 | Allison | 175/35 X |
| 3,204,710 | 9/1965 | Bechem | 175/351 X |
| 3,216,513 | 11/1965 | Robbins et al. | 175/227 |
| 3,572,452 | 3/1971 | Winberg | 175/371 |
| 3,596,724 | 8/1971 | Bechen | 175/374 X |
| 3,604,523 | 9/1971 | Lichte | 175/372 |

*Primary Examiner*—David H. Brown
*Attorney, Agent, or Firm*—Eddie E. Scott

[57] ABSTRACT

A cutter with replaceable cutting elements is adapted to be mounted upon the rotary head of an earth boring machine or upon the body of an earth boring bit. The cutter is used in conjunction with an earth boring machine that functions to form circular kerfs in the formation being bored to fracture rock between a proximate pair of kerfs in a manner to cause fragments of the formation to be separated from the formation being bored. At least one annular cutting ring is mounted on the periphery of the cutter body for contacting the formations and forming a kerf therein. The cutting ring is in the form of a pair of substantially semicircular disk elements that fit upon the periphery of the cutter body. A corresponding pair of semicircular locking elements with taper surfaces are positioned in overlapping relation to the disk elements. The locking elements are securely bolted to the cutter body and insure that the disk elements remain in the proper position for the earth boring operation. A pair of stops project from the cutter body and contact the ends of the semicircular disk elements thereby preventing the disk elements from rotating relative to the cutter body.

4 Claims, 3 Drawing Figures

ROCK BORING CUTTER WITH REPLACEABLE CUTTING ELEMENTS

BACKGROUND OF THE INVENTION

The present invention relates to the art of earth boring and more particularly to an earth boring cutter with replaceable cutting elements.

Conventionally, rotary drilling apparatus and particularly rotary drilling apparatus for boring large diameter holes and tunnels includes a multiplicity of roller cutters. A number of the roller cutters together with their bearings and the saddles in which the cutters and bearings are mounted are positioned on a rotary head or a bit body and used to form holes in the formation being bored. The roller cutters may be conveniently mounted on the rotary cutting head of a tunneling machine or on the body of a raise bit.

A disk type roller cutter is effective in very soft to medium formations. The disk is usually a heat treated alloy steel cutter with an included angle between about 60° and 90°. The disk cutters are usually indexed two or three inches apart. In effect, the disk cutters plow concentric circles around the face of the formation being bored. The cutting disks are indexed so that the formation between disks will break out completely under a given load and R.P.M. This is a very efficient way to cut formations because the cuttings come off the face in relatively large pieces. Disk cutters are not economical in harder formations because the disks dull out quickly in the harder abrasive formations. This is especially detrimental in shaft drilling or raise drilling operations where trip time is costly. It is not practical to make the disks completely of carbide and the brazing on of continuous sintered carbide tips or wedges is also of questionable feasibility from an economical and operational standpoint. Since the bearing life of the roller cutters long outlasts the life of the cutting structure, the cutting structure should be replaced periodically thereby extending the useful lifetime of the cutter. It generally is difficult, expensive and time-consuming to remove the entire cutter in order to replace the cutting element. The cutters are heavy and are often in a position that makes removal of the entire cutter awkward and impractical. For example, it is difficult and time-consuming to remove the cutters on the cutting face of a tunneling machine during a tunneling operation.

DESCRIPTION OF THE PRIOR ART

A general indication of the nature of the prior art relating to roller disk type cutters may be obtained from a consideration of the disclosures in the following U. S. Pat. Nos. In U. S. Pat. No. 3,139,148 to J. S. Robbins, patented June 30, 1964, a rotary boring head having roller cutter disks is shown. A plurality of roller cutter disks are mounted on a support plate adapted to rotate about a horizontal axis. In U. S. Pat. No. 3,216,513 to R. J. Robbins, et al., patented Nov. 9, 1965, cutter assemblies for rock drilling are shown. The cutter assemblies comprise a rotary cutting wheel having a peripheral cutting portion, mounting means including anti-friction bearings on which the cutting wheel is freely rotatable and resiliently cushioned metal-to-metal seal means outboard of the bearings. In U. S. Pat. No. 2,766,977 to J. S. Robbins, patented Oct. 16, 1965, a rotary cutter head for boring type continuous mining machines is shown. The cutter head includes a plurality of integrally connected wheels or rollers which cooperate with each other to effect a plurality of cutting and breaking actions against adjacent cores causing the cores to break easily and continuously thereby allowing rapid and continuous advance of the boring machine. In U. S. Pat. No. 3,444,939 to K. G. Bechem, patented May 20, 1969, a cutting roller for roller type enlarging bits is shown. The cutting roller projects through an opening in a shield. The shield is conical and the cutting ribs of the roller make contact with the rock to be cut along lines generally parallel to the shield face. In U. S. Pat. No. 3,572,452 to D. F. Winberg, patented Mar. 30, 1971, a rolling cutter and seal therefor are shown. The cutter includes at least one bit having an encircling ring or an O-ring base. The bits have a cutting edge formed by two flat surfaces. The flat surfaces may be considered to be planes that rise to an edge. The bits are pressed into circular grooves in the rolling cutter body. In U. S. Pat. No. 3,596,724 to K. G. Bechem, patented Aug. 3, 1971, a cutting roller is shown. The cutting roller has two circumferentially extending parallel cutting ribs. Each rib is provided with a series of wear resistant exchangeable inserts which protect the crown and flank surface of the rib against wear.

The use of replaceable cutting elements in the related drill bit art is known and a representative indication of this art may be obtained from a consideration of the disclosures of the following patents. In U. S. Pat. No. 3,426,860 to G. A. Petersen, patented Feb. 11, 1969, a pilot bit with replaceable teeth is shown. The bit body contains a plurality of tooth holding sockets, a plurality of removable teeth and retainers for holding the teeth in the sockets. In U. S. Pat. No. 1,678,201 to J. P. Samuelson, patented July 24, 1928, a rotary drill bit is shown. The bit includes a cutting element which is formed of identical segments having elongated slots to accommodate bolts and permit the segments to be adjusted or replaced. In U. S. Pat. No. 1,143,275 to H. R. Hughes, patented June 15, 1915, a demountable cutting edge for drilling tools is shown. The cutting edge consists of a cutting or shearing blade in the form of a ring having its outer periphery formed with a knife edge. Set screws hold the cutting or shearing blade in place.

SUMMARY OF THE INVENTION

The present invention provides a cutter for an earth boring system that has a rotary unit which bores into earth formations to form a hole therein. The rotary unit functions to form circular kerfs in the formation being bored to fracture rock between a proximate pair of said kerfs in a manner that causes fragments of the formation to be separated from the formation being bored. The cutter of the present invention is rotatably connected to the rotary unit and adapted to contact the formations and form at least one kerf therein. Replaceable disk cutting elements are mounted on the periphery of the cutter and held in place by retainer elements. The replaceable disk cutting elements allow the cutting structure to be replaced without necessitating removal of the entire cutter from the rotary unit.

The aforementioned advantages of the present invention and other features and advantages will become apparent from a consideration of the following detailed description of the invention when taken in conjunction with the drawings.

DETAILED DESCRIPTION OF THE INVENTION

Figure 1:
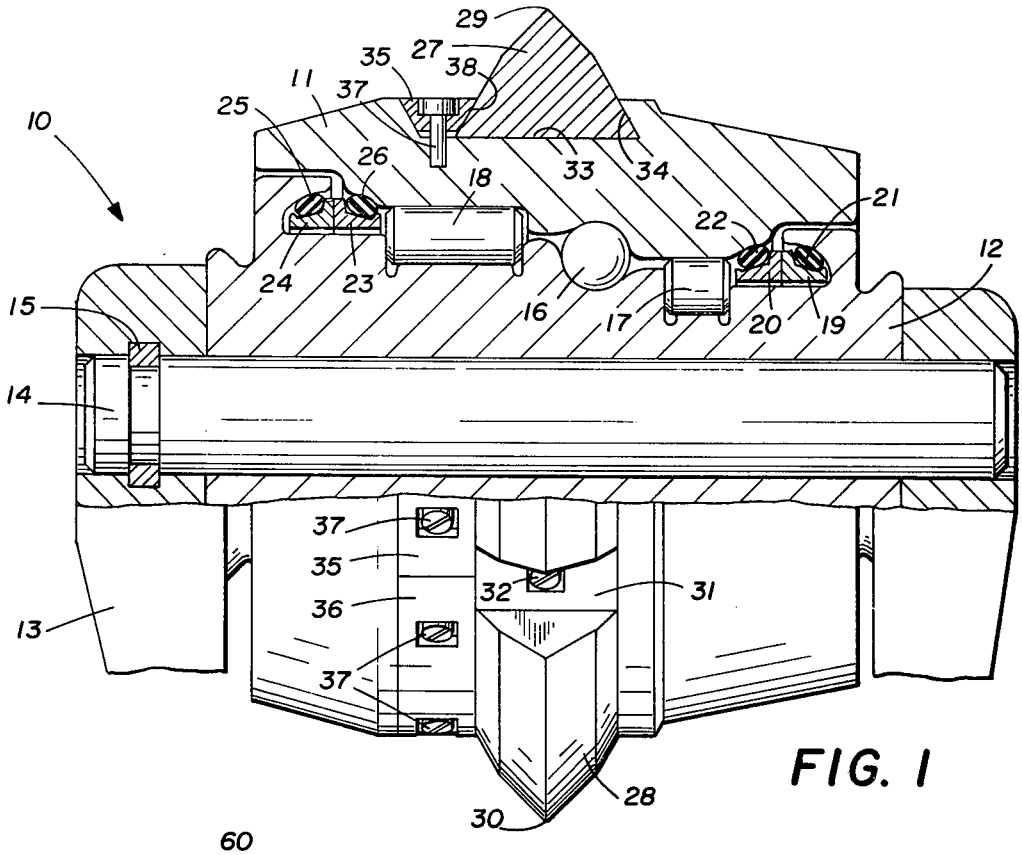
FIG. 1 is an illustration of a cutter constructed in accordance with the present invention positioned in a saddle that is adapted to be connected to a rotary unit of an earth boring system.

Referring now to FIG. 1, a roller disk cutter constructed in accordance with the present invention and generally designated by the reference numeral 10 is illustrated. The cutter 10 includes a cutter shell 11 positioned around a bearing shell 12 with bearing shell 12 being securely locked in a saddle mount 13. The saddle mount 13 may be connected to the rotary head of an earth boring machine or to the body of a bit for boring a large diameter hole. The bearing shell 12 is locked in position in the saddle mount 13 by a pin 14 and a retainer element 15. The bearing shell 12 remains firmly locked in place throughout the drilling operation due to a tenon and groove arrangement disclosed in U. S. Pat. No. 3,203,492 to C. L. Lichte, patented August 31, 1965.

A multiplicity of bearing systems including a series of ball bearings 16, a series of inner roller bearings 17 and a series of outer roller bearings 18 promote rotation of the cutter shell 11 about the bearing shell 12. Lubricant is retained in the bearing area by two sets of seal elements. The inner set of seal elements includes a pair of annular metal seal rings 19 and 20 that are positioned near the inner end of the cutter 10. A flexible rubber O-ring 21 is positioned between seal ring 19 and the bearing shell 12 to retain the seal ring 19 in the desired position and resiliently urge seal ring 19 against seal ring 20. A flexible rubber O-ring 22 is positioned between the cutter shell 11 and the seal ring 20 to retain the seal ring 20 in the desired position and resiliently urge the seal ring 20 against seal ring 19. The outer set of seal elements includes a pair of annular metal seal rings 23 and 24 that are positioned near the outer end of cutter 10. A flexible rubber O-ring 25 is positioned between the seal ring 24 and bearing shell 12 to retain the seal ring 24 in the desired position and resiliently urge seal ring 24 against seal ring 23. A flexible rubber O-ring 26 is positioned between the cutter shell 11 and seal ring 23 to retain seal ring 23 in the desired position and resiliently urge seal ring 23 against seal ring 24.

A split ring assembly consisting of a pair of substantially semicircular cutting elements 27 and 28 are positioned around the periphery of the cutter shell 11. The cutting elements 27 and 28 may be constructed of a heat treated alloy steel or of other suitable materials. The cutting elements 27 and 28 each have a cutting edge 29 and 30 respectively adapted to contact the formations and form a kerf therein. A pair of stop elements, stop element 31 being shown in FIG. 1, are positioned between the ends of cutting elements 27 and 28 and firmly secured to the cutter shell 11 by bolts, bolt 32 being shown in FIG. 1. The stops prevent the cutting elements 27 and 28 from rotating on the cutter shell 11 during operation. The cutting elements 27 and 28 fit within a groove 33 in the outer surface of the cutter shell 11. The wall 34 on one side of groove 33 tapers inward and conforms with one side of the split ring assembly. A split ring wedge, consisting of retainer elements 35 and 36, is bolted to the cutter shell 11 by a series of bolts, each of the bolts being designated by the reference numeral 37. The split ring wedge includes a side wall 38 that tapers inward so as to overlap the cutting elements 27 and 28 respectively. The split ring wedge securely locks the cutting elements 27 and 28 in place on the cutter shell 11.

Figure 2:
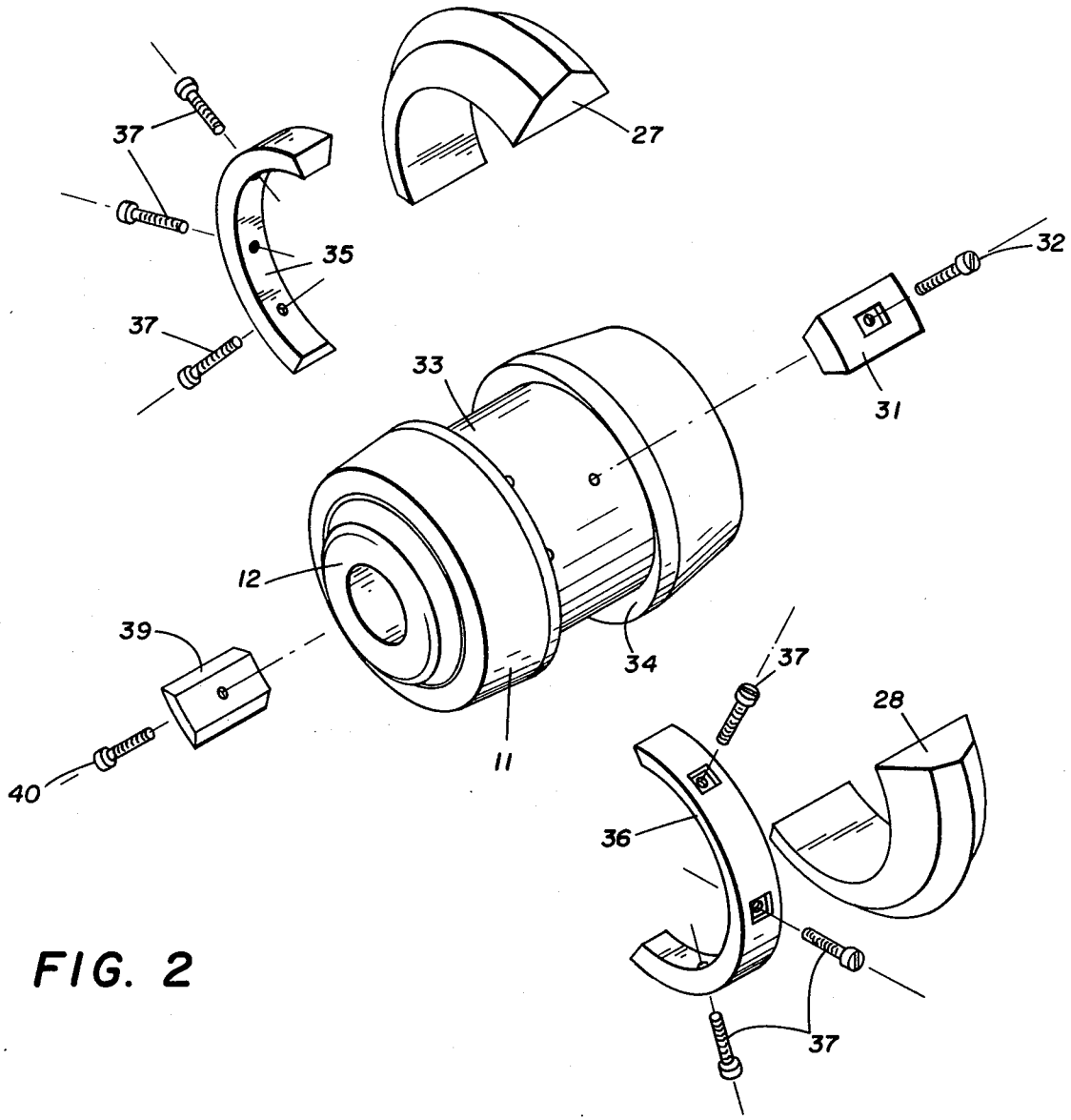
FIG. 2 is an exploded view of the cutter shown in FIG. 1.

The structural details of a cutter constructed in accordance with the present invention having been described, the operation of the cutter 10 will now be considered with reference to FIG. 2. The cutter 10 is illustrated by an exploded view in FIG. 2. The cutter shell 11 is adapted to be mounted in a saddle (not shown) that is affixed to the rotary head of an earth boring machine or to the body of a raise bit. The cutting elements 27 and 28 contact the formations and form a circular kerf therein. The portions of the formation between adjacent kerfs tend to fracture out and the fragments are separated from the formations being bored to form the desired hole or tunnel. Since the cutting elements 27 and 28 become dull before any of the other elements of the roller disk cutter fail, it is desirable to replace them. In many instances, it is not desirable or practical to remove the entire cutter from the saddle in order to replace the cutting structure.

In order to replace the cutting structure of the cutter of the present invention, the series of bolts 37 are loosened and the split ring wedge consisting of retainer elements 35 and 36 is removed from the cutter shell 11. The cutting elements 27 and 28 may be easily and quickly removed from their position in groove 33 and new cutting elements inserted in their place. The retainer elements 35 and 36 are replaced so that the overlapping taper walls of the split ring wedge overlap the cutting elements 27 and 28. The bolts 37 are replaced and tightened to secure the cutting elements 27 and 28 in place. The stop 31 between cutting elements 27 and 28 prevents the cutting elements from rotating relative to the cutter shell 11 during the earth boring operation. The stop 31 is held in place on the cutter shell 11 by bolt 32. A second stop 39 serves the same purpose and is positioned between the other end of the cutting elements 27 and 28. A bolt 40 secures the stop 39 in place on the cutter shell.

Figure 3:
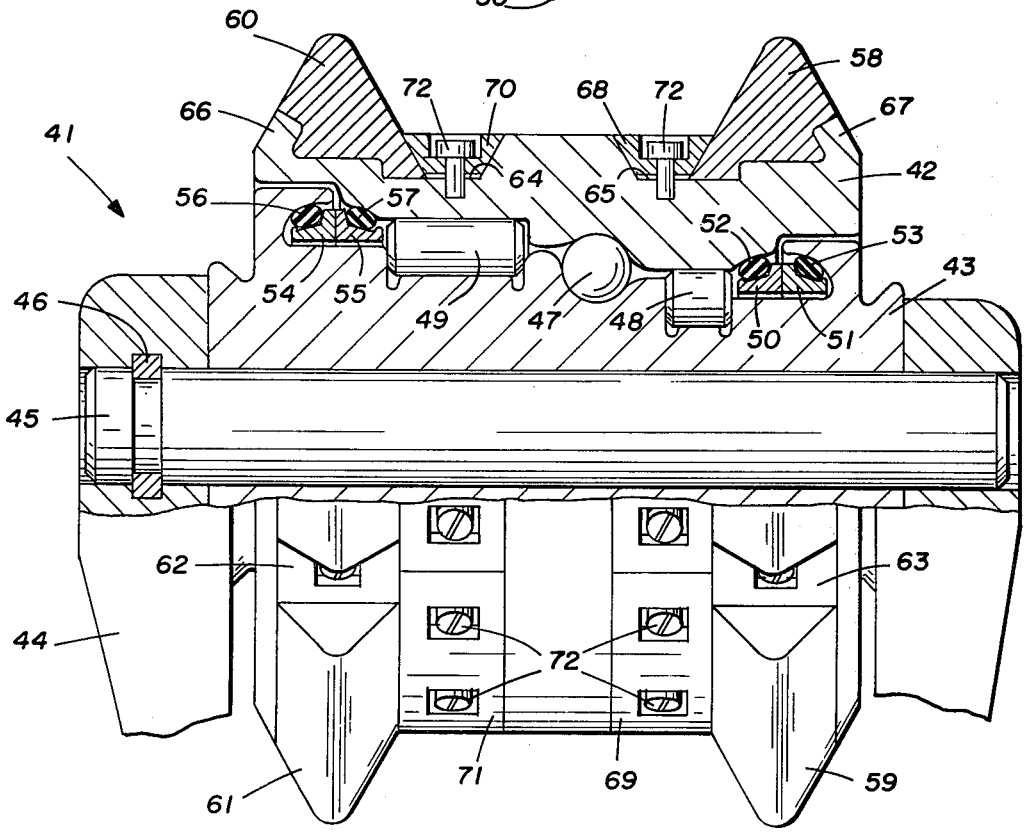
FIG. 3 is an illustration of another embodiment of the cutter of the present invention.

Referring now to FIG. 3, another embodiment of the present invention is shown. A roller disk cutter generally designated by the reference numeral 41 includes a plurality of cutting elements. The cutter 41 includes a cutter shell 42 positioned around a bearing shell 43 with bearing shell 43 being securely locked in a saddle mount 44. The saddle mount 44 may be connected to the rotary head of an earth boring machine or to th body the a bit for boring a large diameter hole. The bearing shell 43 is locked in position in the saddle mount 44 by a pin 45 and a retainer element 46. The bearing shell 43 remains firmly locked in place throughout the drilling operations due to a tenon and groove arrangement disclosed in U. S. Pat. No. 3,203,492 to C. L. Lichte, patented Aug. 31, 1965.

A multiplicity of bearing systems including a series of ball bearings 47, a series of inner roller bearings 48 and a series of outer roller bearings 49 promotes rotation of the cutter shell 42 about the bearing shell 43. Lubricant is retained in the bearing area by two sets of seal elements. The inner set of seal elements includes a pair of annular metal seal rings 50 and 51 positioned near the inner end of the cutter 41 and held in place by a pair of flexible rubber O-rings 52 and 53. The outer set of seal elements includes a pair of metal seal rings 54 and 55 that are positioned near the outer end of cutter 41 and held in place by a pair of flexible rubber O-rings 56 and 57.

The cutting structure of the cutter 41 includes a pair of split ring assemblies each consisting of a pair of substantially semicircular cutting elements. The inner split ring assembly consists of semicircular cutting elements 58 and 59 and the outer split ring assembly consists of cutting elements 60 and 61. The split ring assemblies may be constructed of a heat treated alloy steel or of other suitable materials. The split ring assemblies are prevented from rotating relative to the cutter 41 during the earth boring operation by stop elements 62 and 63 that project from the cutter shell 42.

The split ring assemblies fit within grooves 64 and 65 in the outer surface of the cutter shell 42. The split ring assemblies are maintained in position in the grooves 64 and 65 by a pair of ridges 66 and 67 proximate the grooves 64 and 65 and a pair of split ring wedges consisting of retainer elements 68, 69, 70 and 71. The retainer elements are held in place on the cutter shell 42 by a series of bolts, each of the bolts being designated by the reference numeral 72. The split ring wedges have a taper surface that overlaps the cutting elements 58, 59, 60 and 61 and insures that they will remain in place throughout the drilling operation. The cutting elements 58, 59, 60 and 61 may be easily replaced by loosening the bolts 72, removing the split ring wedges thereby freeing the cutting elements. New cutting elements are inserted in place on the cutter shell 42 and the split ring wedges replaced.

The embodiments of an invention in which an exclusive property or privilege is claimed are defined as follows:

1. A cutter for an earth boring system that has a rotary unit which bores into earth formations to form a hole therein, said rotary unit functioning to form circular kerfs in the formation being bored to fracture rock between a proximate pair of said kerfs in a manner that causes fragments of the formation to be separated from the formation being bored, comprising:

a cutting wheel mounted upon said rotary unit for rotary motion to roll along the kerfs being cut;

replaceable cutting means substantially encircling said cutting wheel for contacting said formations and forming a kerf therein, said cutting means consisting of a plurality of cutting elements, each of which partially encircle said cutting wheel;

means for removably affixing said cutting means to said cutting wheel;

said means for removably affixing said cutting means to said cutting wheel including a plurality of locking elements adapted to contact said cutting means and retainer means for affixing said locking elements to said cutting wheel, said locking elements include tapered surfaces that overlap said cutting elements; and means projecting from said cutting wheel between cutting elements for preventing relative movement between said cutting wheel and cutting elements.

2. The cutter of claim 1 wherein said cutting elements consist of a pair of substantially semicircular cutting members adapted to fit on said cutting wheel and said locking elements consist of a pair of substantially semicircular locking members having a tapered surface adapted to contact said semicircular cutting members in overlapping relationship.

3. The cutter of claim 2 wherein said retainer means for affixing said locking elements to said cutting wheel consist of a plurality of bolts for connecting said locking elements to said cutting wheel.

4. A cutter for the rotary unit of an earth boring system that functions to form a hole in earth formations by forming a series of kerfs in the formations thereby fracturing the portions of the formation between a proximate pair of kerfs, comprising:

a cutter body;

means for rotatably mounting said cutter body on said rotary unit;

substantially annular disk cutting surface means for forming the kerfs in the formations;

groove means in said cutter body for receiving said annular disk cutting surface means, said substantially annular disk cutting surface means consisting of a plurality of curved cutting elements adapted to fit within the groove means in said cutter body;

retainer means for locking said annular disk cutting surface means in said groove, said retainer means consisting of a plurality of retainer elements with taper surfaces that overlap said substantially annular disk cutting surface means and a multiplicity of locking elements for locking said retainer elements to said cutter body; and stop means that project from said cutter body for preventing said annular disk cutting surface means from rotating relative to said cutter body.

* * * * *